US011485531B2

(12) United States Patent
Rasi et al.

(10) Patent No.: US 11,485,531 B2
(45) Date of Patent: Nov. 1, 2022

(54) MACHINE FOR PACKAGING SOFT PRODUCTS

(71) Applicant: T.M.C. S.P.A., Castel Guelfo (IT)

(72) Inventors: Michele Rasi, Ferrara (IT); William Rossi, San Giorgio di Piano (IT)

(73) Assignee: T.M.C. S.P.A., Castel Guelfo (IT)

( * ) Notice: Subject to any disclaimer, the term of this patent is extended or adjusted under 35 U.S.C. 154(b) by 138 days.

(21) Appl. No.: 16/763,044

(22) PCT Filed: Nov. 9, 2018

(86) PCT No.: PCT/IB2018/058824
§ 371 (c)(1),
(2) Date: May 11, 2020

(87) PCT Pub. No.: WO2019/097377
PCT Pub. Date: May 23, 2019

(65) Prior Publication Data

US 2020/0391892 A1 Dec. 17, 2020

(30) Foreign Application Priority Data

Nov. 14, 2017 (IT) ..... 102017000130063

(51) Int. Cl.
*B65B 35/30* (2006.01)
*B65B 25/14* (2006.01)
(Continued)

(52) U.S. Cl.
CPC ..... *B65B 25/146* (2013.01); *B65B 11/22* (2013.01); *B65B 35/30* (2013.01); *B65B 59/005* (2013.01)

(58) Field of Classification Search
CPC ..... B65B 35/30; B65B 59/04; B65B 25/146; B65B 11/22; B65B 59/005
(Continued)

(56) References Cited

U.S. PATENT DOCUMENTS 4,501,351 A 2/1985 Tracy
4,718,540 A 1/1988 Greenwell
(Continued)

FOREIGN PATENT DOCUMENTS

EP 0995682 A2 4/2000
EP 1067048 A1 * 1/2001 ..... B65B 25/146
(Continued)

OTHER PUBLICATIONS

International Search Report and Written Opinion dated Jan. 29, 2019 for counterpart International Application No. PCT/IB2018/058824.
(Continued)

*Primary Examiner* — Chinyere J Rushing-Tucker
(74) *Attorney, Agent, or Firm* — Shuttleworth & Ingersoll, PLC; Timothy Klima

(57) ABSTRACT

A machine for packaging soft products, including a conveyor defining a ring-shaped path having an active linear lower branch facing a feed plane and a non-active linear upper branch Each of a plurality of carriages supports a tooth, projecting towards the feed plane during the passage on the lower branch. A transfer device moves one group of products at a time, with a corresponding sheet of wrapping material folded around the group, towards the feed plane and to a receiving compartment defined by a first and a second tooth, along a second direction transversal to a first direction. Along the lower linear branch there are a number of teeth equal to the number of groups positioned or arrived on the feed plane. Each tooth is configured to define simultaneously a pushing tooth and a tooth containment when the tooth is interposed between two groups along the feed plane.

10 Claims, 7 Drawing Sheets

(51) Int. Cl.
*B65B 11/22* (2006.01)
*B65B 59/00* (2006.01)

(58) Field of Classification Search
USPC ..... 53/203
See application file for complete search history.

(56) References Cited

U.S. PATENT DOCUMENTS

| | | | | |
|---|---|---|---|---|
| 5,331,788 | A | 7/1994 | Cinotti | |
| 5,465,550 | A | 11/1995 | Dall Omo | |
| 5,560,473 | A | 10/1996 | Ivancso, Jr. et al. | |
| 5,725,084 | A * | 3/1998 | Jager | B65G 15/42 198/848 |
| 5,911,303 | A | 6/1999 | Malanowski | |
| 5,937,620 | A | 8/1999 | Chalendar | |
| 6,510,939 | B2 | 1/2003 | Gamberini | |
| 6,606,841 | B1 | 8/2003 | Germunson | |
| 6,799,410 | B2 | 10/2004 | Gamberini | |
| 6,811,024 | B2 | 11/2004 | Wieduwilt et al. | |
| 7,530,448 | B2 | 5/2009 | Henderson et al. | |
| 7,717,253 | B2 | 5/2010 | Lord | |
| 7,789,219 | B2 | 9/2010 | Baldanza et al. | |
| 8,016,103 | B2 * | 9/2011 | Krischer | B65G 17/44 198/853 |
| 8,727,106 | B2 | 5/2014 | Bernardi | |
| 2016/0362259 | A1 * | 12/2016 | Papsdorf | B65G 54/02 |
| 2019/0077532 | A1 * | 3/2019 | Catellani | B65B 55/103 |

FOREIGN PATENT DOCUMENTS

| | | | | |
|---|---|---|---|---|
| EP | 1067048 | A1 | 1/2001 | |
| IT | UB20159738 | A1 | 6/2017 | |
| WO | WO-2020245853 | A1 * | 12/2020 | B65B 51/14 |

OTHER PUBLICATIONS

Rasi et al.—U.S. Appl. No. 16/763,053, filed May 11, 2020.
International Search Report and Written Opinion dated Jan. 29, 2019 from related International Patent Application No. PCT/IB2019/058826.

* cited by examiner

Fig.1
(PRIOR ART)
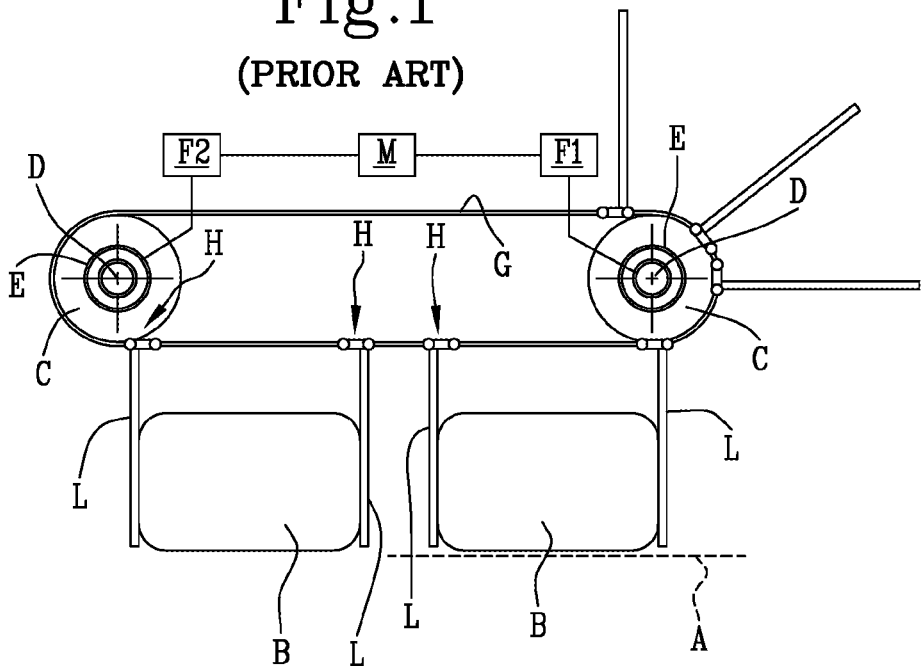
Fig.2
(PRIOR ART)
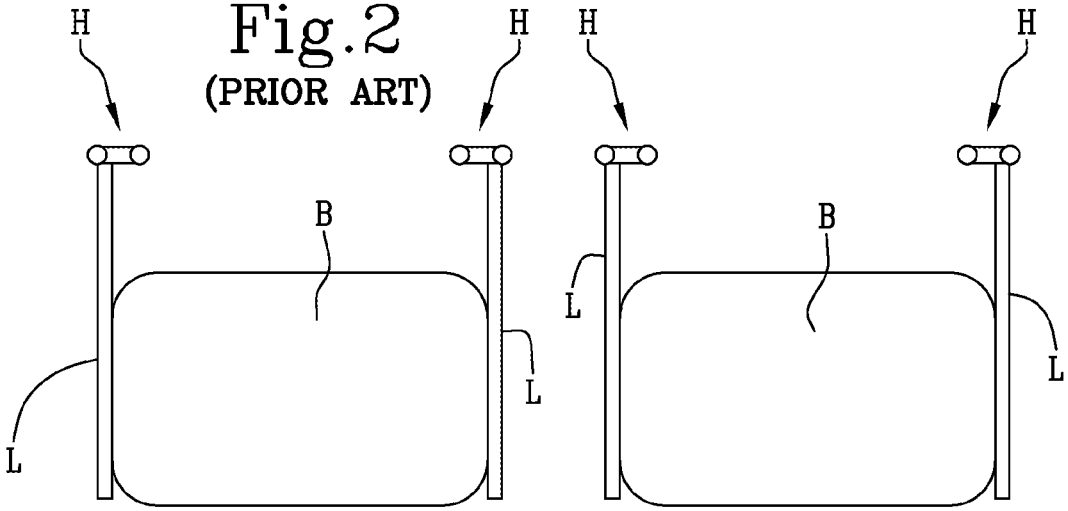
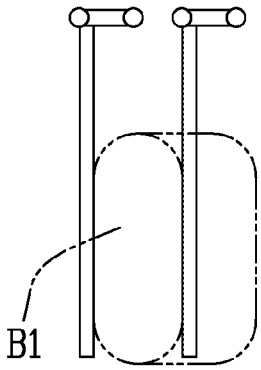
Fig.3
(PRIOR ART)

MACHINE FOR PACKAGING SOFT PRODUCTS

This application is the National Phase of International Application PCT/IB2018/058824 filed Nov. 9, 2018 which designated the U.S.

This application claims priority to Italian Patent Application No. 102017000130063 filed Nov. 14, 2017, which application is incorporated by reference herein.

TECHNICAL FIELD

This invention relates to a machine for packaging soft products, such as, for example, but without limiting the scope of the invention, those for sanitary use, in particular rolls of tissue paper products such as rolls of paper for sanitary and/or household use or unwoven products such as nappies.

BACKGROUND ART

Currently, in the automatic machines which perform the packaging of the above-mentioned products, the products are grouped together in one or more layers, such as, for example, layers composed of several rolls aligned in rows, and they are sent to a feed station downstream of which there is a packaging unit.

For reasons of simplicity, a machine for making packaging rolls is described below.

The purpose of the packaging unit is to wrap the group of rolls with a sheet of heat-sealable wrapping material, for example, but without restricting the scope of the invention, made of transparent polypropylene, and to stabilise the wrapper thus obtained.

According to a known machine configuration, the station for feeding the rolls and the packaging unit are arranged one after another, the first beneath the second and with the interposition of a horizontal elevator plate which receives the rolls in a predetermined format from the feed station and transfers them to the packaging unit.

The elevator plate lift is generally combined with two vertical walls which laterally delimit the size, that is to say, the format, of the group of rolls, and which allow the format to be stably maintained, in particular when this has two or more layers superposed on each other.

The packaging unit comprises, usually, a chain or belt conveyor, which is looped and is provided with U-shaped pockets (defined by pairs of drive teeth), designed to house respective groups of rolls. The conveyor is motor-driven in a stepwise fashion and is positioned above the feed station for stopping, at each pause, a relative pocket with the respective inlet opening facing the elevator plate.

The packaging unit is associated with a line for feeding wrapping sheets, which, simultaneously with each positioning of a pocket, feeds a sheet of wrapping material to the pocket which is positioned facing the elevator plate. The sheet of wrapping material is fed in such a way as to close the inlet opening of the pocket, so that, with the subsequent lifting of the elevator plate, the sheet is intercepted by the group of rolls and is forced by them to enter into the pocket.

The insertion of the groups of rolls in the pocket determines a U-shaped folding of the sheet of wrapping material around the group, after which the sheet of wrapping material comes out of the pocket with two relative end flaps.

According to a known packaging method, a first of the two flaps is folded at a right angle on the group of rolls by a first folding device of the packaging unit, and, subsequently, the second of the two flaps is folded, again at a right angle, and superposed on the first flap by a second folding device of the packaging unit.

After folding, the group of rolls and the wrapped film are transported by the conveyor, in a direction transversal to the lifting direction, towards a tunnel equipped with units for closing the package (bottom and tops).

Thus, during movement inside the tunnel, firstly the zone for superposing the flaps is subjected to an operation for stabilising the wrapping material consisting, usually, in a reciprocal sealing of the flaps (as mentioned, further downstream relative to the folding area, that is, during step-like feeding of the above-mentioned pockets) in the tunnel for closing the wrapping film and subsequently also along the two heads formed.

Of particular interest in this invention is the above-mentioned chain or belt conveyor.

This unit comprises (see also patent EP 1 067 048 of the same Applicant as this invention) in a minimum configuration (see FIGS. 1 and 2):

- a plane A for feeding groups of products B (horizontal), positioned between two flanks;
- a drive unit comprising a plurality of pulleys C located at the two ends of the feed plane A and keyed on at least two power-driven shafts D and E by a first F1 and a second F2 motor; on the pulleys C are wound at least two pairs of chains or belts G parallel to each other to define a ring-shaped path with an active linear lower branch facing the feed plane A and a non-active linear upper branch;
- a plurality of crosspieces or carriages H connected to the pairs of chains or belts G along the ring-shaped path and each supporting at least one tooth L configured for retaining and feeding along the feed plane A the groups of products B positioned between consecutive pairs of the teeth L;
- a control unit M connected to the motors F1 and F2 is configured to control their operation in accordance with variations in the distance between the pairs of teeth L on the relative pairs of rings of chain or belt G as a function of the variations in size of the groups of products B.

Therefore, the traditional arrangement of the machine outfeed conveyor is such that according to the use until now there is at least one pair of motors which each control a series of belts or chains (two or multiples of two) and fastened to the above-mentioned belts and there are a series of drive carriages at a predefined spacing equal to the extension of the belt or chain divided by the maximum width of the group of products to be retained between the drive teeth.

Each of the motors moves a series of carriages each having a distance equal to the predetermined spacing (format); when a pack is to be contained with widths greater than that of the spacing it is necessary to change it, removing the series of carriages and reducing their number along the extension of the entire path of the chain or belt through a manual operation.

Similarly, in the presence of the second motor which jointly with the first moves a second series of carriages equidistant by the spacing of the first actuator, it is necessary, for a change of spacing, to remove and move or only remove both the carriages of the first actuator and those of the second.

This is because usually in a pair of containment teeth one has the pushing function (upstream relative to a feed direction along the active branch) and one has a containment function (downstream relative to the feed direction).

Starting from this base configuration, the conveyor has, over time, had a series of developments, as required by market needs.

More specifically, a high flexibility of the spacing or format changes between the teeth has been requested to have extremely an small spacing (width with a single product) or a spacing of maximum dimension.

To obtain this, the number of chains and belts and the number of power-driven units which control them has been increased in order to have a control even on individual carriages and not on a plurality of carriages, modifying the spacing of pairs independently.

However, these modifications to the conveyor have given rise to several drawbacks.

A first drawback is due to the long length/extension of the entire ring-shaped path which makes it necessary to increase the distances between the unit and the rest of the outfeed stations.

Moreover, the greater the extension of the group the greater will be the number of carriages in transit, since the extension and the spacing is given by the maximum width of the product to be packaged.

Now, the greater the spacing (and the extension), the greater will be the speed of the power-driven units when it is necessary to package groups of products with small spacing, but if the groups have limited width and the packaging speed requested is high (in view of the length of the path) then the rotation speeds become high, to the detriment of the winding quality and reliability of the machine.

A further drawback currently present in the structure of the unit is due to the need to assemble and dismantle carriages which, according to the format needs, must be carried out manually.

Currently, in fact, the system needs a manual intervention to be able to apply or remove the carriages from the belts or chains by means of a long and laborious mechanical operation.

Another drawback is due to the constructional profile of each tooth, which has the shape of an upturned "L" in which, for each pair of teeth forming the containment pocket, each smaller stretch of "L" (used for connection to the carriage) faces the other one. This configuration creates a problem which arises when the size of the formats (labelled B1 in FIG. 3) is less than the sum of the two smaller stretches of "L" (minimum spacing) and it makes it necessary to use the rotation of the pushing or containing teeth to be able to efficiently retain the products (see FIG. 3).

In other words, when a configuration is to be made with a size less than the above-mentioned minimum spacing, due to the contact of the upper parts of the two teeth forming the pair, it is necessary to rotate one of the two teeth. This operation must be repeated for all the teeth operating along the annular path.

All these situations result in a significant waste of non-operational time on the machine.

DISCLOSURE OF THE INVENTION

The aim of this invention is to provide a machine for packaging soft products, such as, for example, the rolls of tissue paper products such as rolls of paper for sanitary and/or domestic use which overcomes the above-mentioned drawbacks of the prior art.

More specifically, the aim of this invention is to provide a machine for packaging soft products which can increase and make simpler the size changes of the groups of product being wrapped without modifying the basic structures of the base of the unit for moving the products.

A further aim of this invention is to provide a machine for packaging soft products which is able to reduce the problems of speed reduction for moving the carriage/tooth, in particular for the smaller formats without reducing the productivity and the quality of the packaging of the product.

A further aim of this invention is to provide a machine for packaging soft products which is able to reduce the time for modifying the configurations of the teeth on the carriages, whilst maintaining a high level of safety of drive and containment on the packs of products.

These aims are fully achieved by the machine for packaging soft products according to the invention as characterised in the appended claims.

BRIEF DESCRIPTION OF DRAWINGS

The features of the machine will become more apparent from the following detailed description of a preferred, non-limiting embodiment of it, with reference to the accompanying drawings, in which:

FIG. 1 illustrates a schematic side view with some parts cut away of a machine for packaging soft products of known type;

FIG. 2 illustrates an enlarged detail of the machine of FIG. 1;

FIG. 3 illustrates a detail of two drive teeth of the machine of FIG. 1 in a different operating configuration;

DETAILED DESCRIPTION OF PREFERRED EMBODIMENTS OF THE INVENTION

Figure 4:
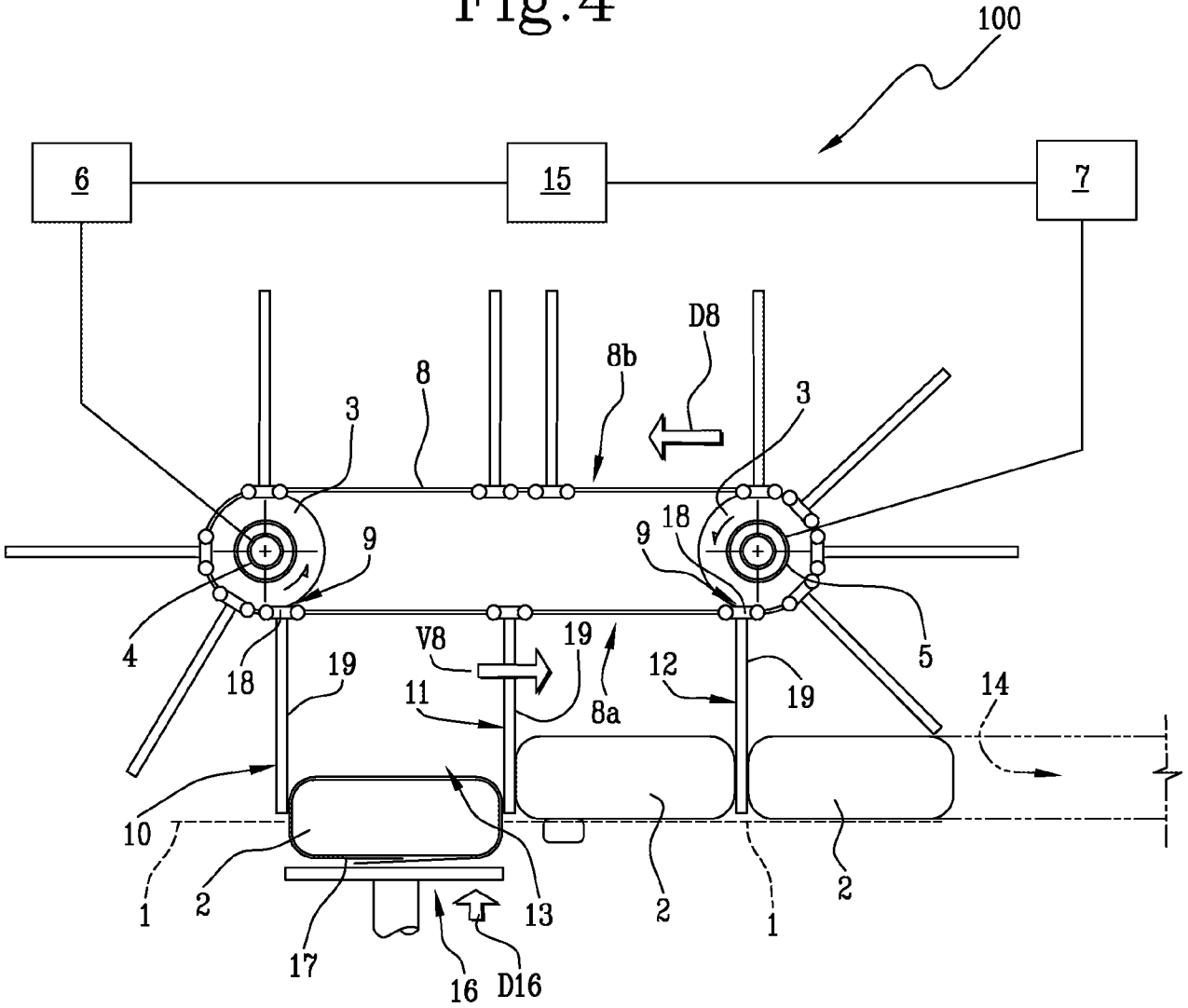
FIG. 4 illustrates a schematic front view with some parts cut away in order to better illustrate others of a machine for packaging soft products, according to this invention.
Figure 5:
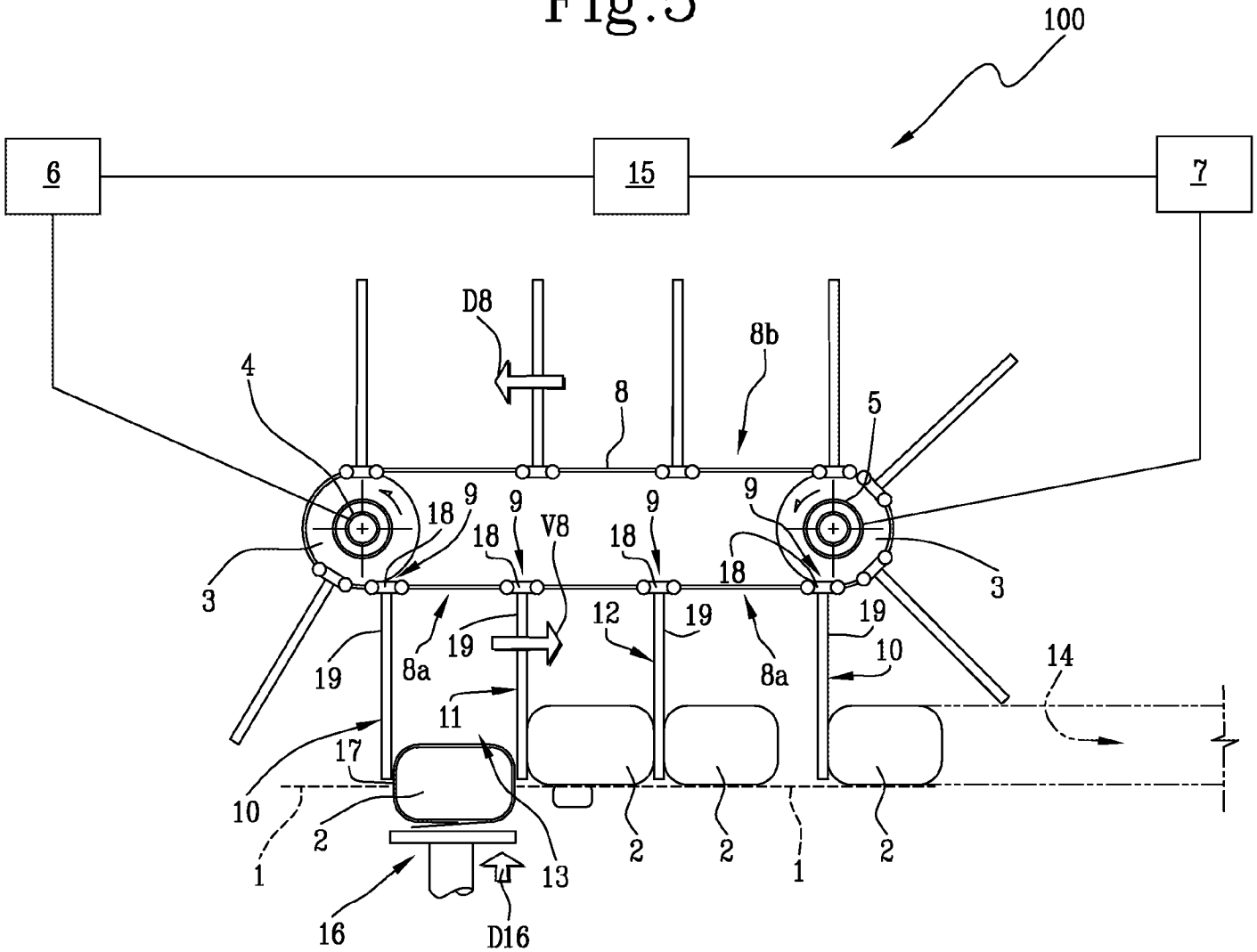
FIG. 5 illustrates a schematic front view with some parts cut away in order to better illustrate others of a machine for packaging soft products, according to this invention, in a different operating configuration.
Figure 6:
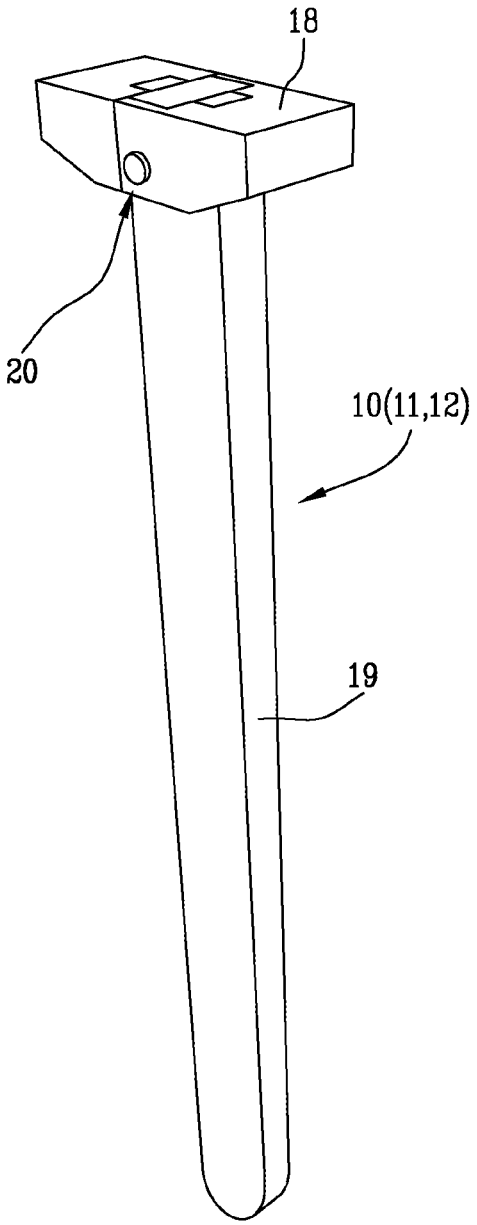
FIG. 6 illustrates a schematic perspective view of a drive tooth used on the machine of FIGS. 4 and 5.
Figure 7:
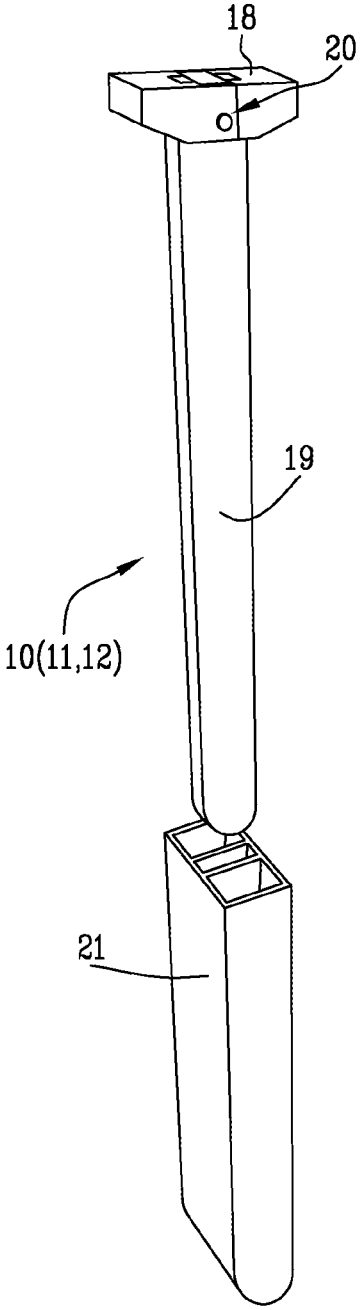
FIG. 7 illustrates a schematic exploded perspective view of a first variant embodiment of the drive tooth of FIG. 6.
Figure 8:
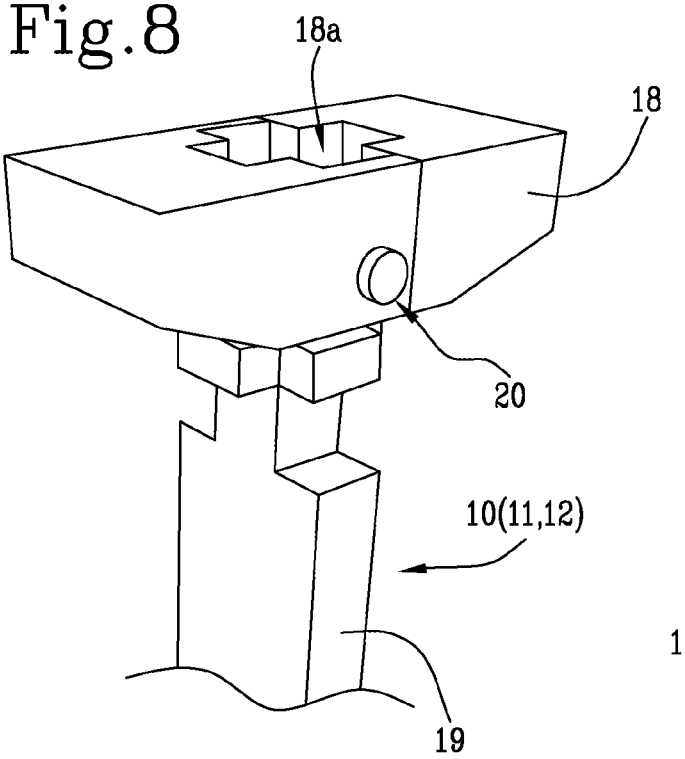
FIGS. 8 and 9 illustrate schematic perspective views of a corresponding detail of the drive tooth of FIG. 6 or 7.
Figure 9:
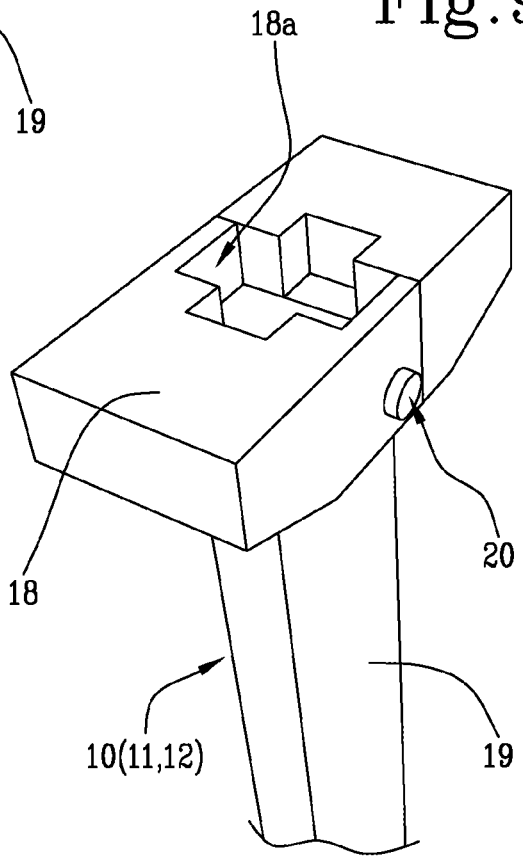
Figure 10:
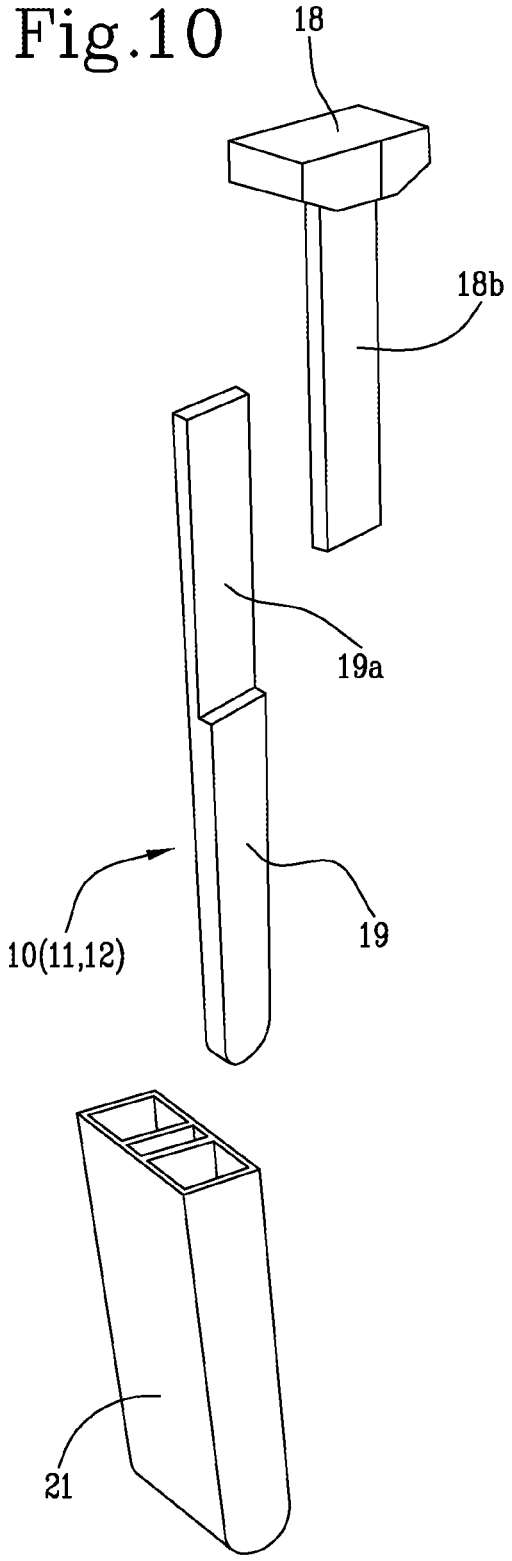
FIG. 10 illustrates a schematic exploded perspective view of a second embodiment of the drive tooth used on the machine of FIGS. 4 and 5.
Figure 11:
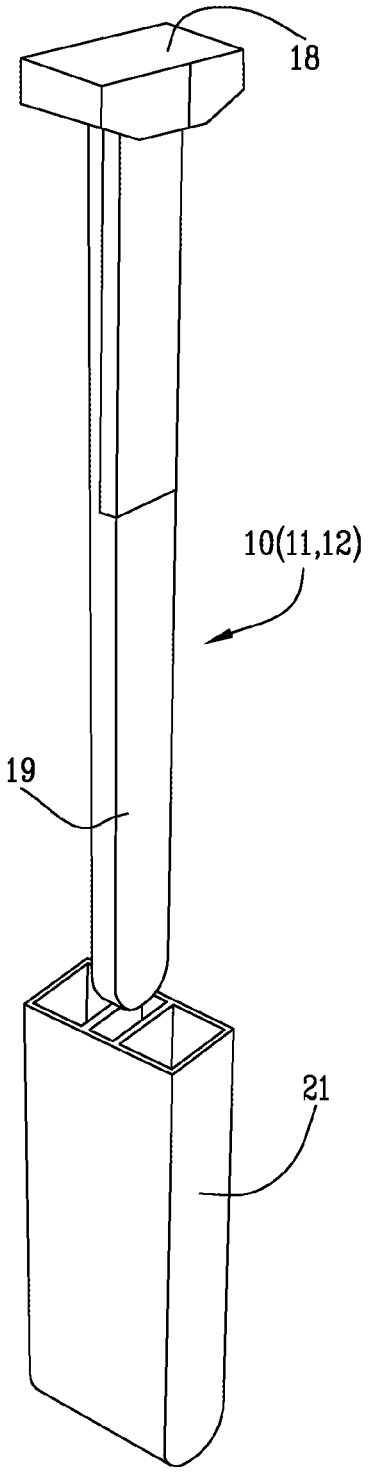
FIG. 11 illustrates a schematic exploded perspective view of the drive tooth of FIG. 10 partly assembled.
Figure 12:
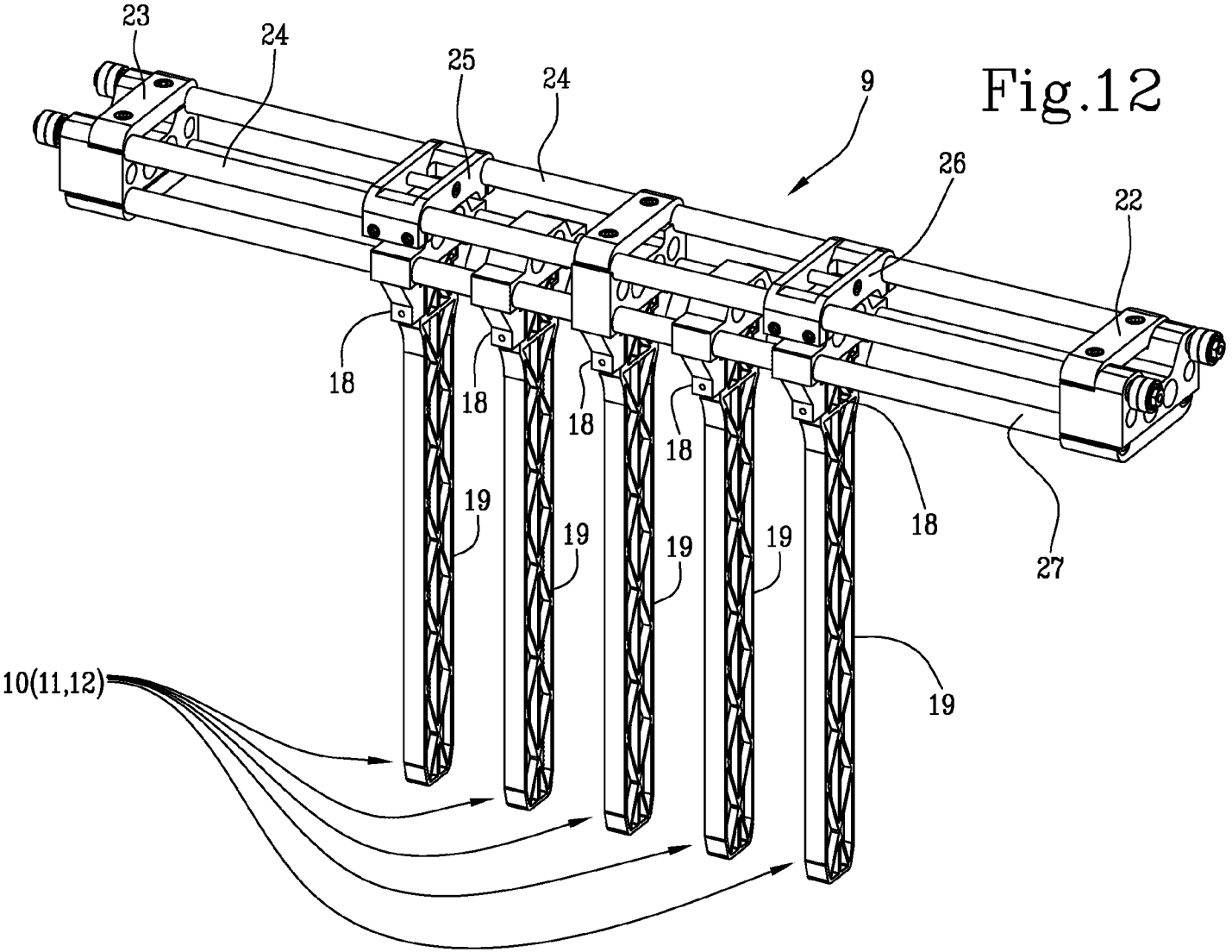
FIG. 12 illustrates a perspective view of a support carriage of the drive teeth used on the machine of FIGS. 4 and 5.

With reference to the accompanying drawings, in particular FIGS. 4 and 5, the machine according to the invention, labelled 100 in its entirety, is used for packaging soft products, such as, for example, but without restricting the scope of the invention, those for sanitary use, such as rolls of tissue paper products such as, for example, rolls of paper for sanitary and/or household use or unwoven products such as nappies.

Again with reference to FIGS. 4 and 5, the machine 100 comprises a plane 1 for feeding groups 2 of products (where groups of products may refer to a single product being wound, or a plurality of products arranged on several rows and several layers).

The feed plane 1 is usually delimited by a pair of flanks.

The machine 100 also comprises a plurality of pulleys 3 positioned at the two ends of the feed plane 1 and connected on at least two power-driven shafts 4, 5 (usually coaxial to each other and completed by a pair of driven shafts, but merely by way of example). Each shaft 4 and 5 is driven independently by at least a first 6 and a second 7 motor.

On the pulleys 3 are wound two pairs of chains or belts 8 (positioned close to the flanks) parallel to and independent from each other, movable along a first direction D8 and a feed direction V8, to define a ring-shaped path having an active linear lower branch 8*a* facing the feed plane and a non-active linear upper branch 8*b*.

The machine 100 comprises a plurality of carriages 9 which are connected, alternatively in sequence, to the pairs of motor-driven chains or belts 8 and distributed along the ring-shaped path.

Each carriage 9 supports at least one tooth 10, 11, 12 (normally a plurality of between 2 and 5), projecting towards the feed plane 1 during the passage on the lower branch 8*a*.

Each tooth 10, 11, 12 is configured for retaining and feeding along the feed plane 1 the groups 2 of products from a receiving compartment 13 to a zone 14 for unloading and releasing the group 2 of products (the unloading and releasing zone 14 coincides with a tunnel for transfer and definitive closing of the packet).

The machine 100 also comprises a control unit 15 (shown here by a block) connected to the motors 6, 7 is configured to control their operation in accordance with variations in the distance between the carriages (9) on the relative pairs of chains or belts 8 as a function of the variations in size of the groups 2 of products.

The machine 100 comprises transfer means 16 for moving one group 2 of products at a time, with a corresponding sheet 17 of wrapping material folded into a "U" shape around the group 2 of products, towards the feed plane 1 and to the receiving compartment 13 defined by a first 10 and a second 11 tooth, along a second direction D16 transversal to the first direction D8.

The transfer means 16 comprise an elevator plate which is able to receive the group of products at a first lower height and lift the group of products to a second upper height corresponding to the receiving compartment defined between the first and second tooth 10 and 11.

As illustrated, along the lower linear branch 8*a* of the chains or belts 8 there is a number of teeth 10, 11, 12 equal to the number of groups 2 of products positioned or arrived on the feed plane 1, in the operational stretch between the compartment 13 for receiving the group 2 of products and up to the unloading and releasing zone 14.

Each tooth 10, 11, 12 is configured along the operational stretch to define simultaneously both a pushing tooth and a tooth containment when the same tooth 10, 11, 12 is interposed between two groups 2 of consecutive products along the feed plane A.

As illustrated, the lower linear branch 8*a* defined by the belts or chains 8 has a succession of teeth 10, 11, 12 along the operational stretch, comprising at least, in a minimum operating configuration:

a first tooth 10 for pushing and a second tooth 11 for containing positioned on opposite sides of the receiving compartment 13 for receiving a first group 2 of products;

the second tooth 11, positioned downstream relative to the first tooth 10 with reference to the feed direction V8, is interposed between the first group 2 of products and a second group 2 of products, located downstream of the first group 2 of products relative to the feed direction V8, in such a way as to also define a tooth for pushing the second group 2 of products (towards the unloading and releasing zone 14).

Again as shown in FIGS. 4 and 5, the minimum configuration may comprise a third tooth 12, positioned downstream of the second tooth 11 with reference to the feed direction V8, interposed between the second group 2 of products and a third group 2 of products, positioned downstream of the second group 2 of products relative to the feed direction V8, in such a way as to define a tooth for containing the second group 2 of products and a tooth for pushing the third group 2 of products towards the unloading and releasing zone 14.

In other words, the system present on the transfer means comprises a pair of teeth (10 and 11) controlled, in this case, by the corresponding first and second motor 6 and 7. These two teeth contain the group of products in elevation forming the receiving compartment 13.

The same teeth move together and move the group of products by a distance equal to the width of the group of products plus the dimension of the tooth.

This operating parameter has the advantage, with respect to the prior art systems, that the feed step is substantially equal to the size of the pack and not to the step defined mechanically on the machine.

Subsequently, the group of products can be subjected to a lower sealing of the film which surrounds the group of products, whilst it remains between the two teeth until sealing is completed.

In this second movement the tooth labelled 10 (motor 6) moves to the position of the tooth 11 (motor 7) and contains (downstream) the group 2 of products arriving from the receiving compartment 13 which must then be sealed.

During this second movement, the tooth 11 can start pushing the group of products and without any other stop it moves up to the zone 14 for unloading and releasing the group of sealed products where there are units for final closing of the group (typically those for the lateral sealing).

This tooth then completes its stroke positioning behind the teeth which are stationary awaiting their turn to restart the cycle.

This structure makes it possible to reduce the problems of changing the spacing in the machine, the speed reduction for movement of the carriage/tooth (especially for the smallest formats) and rotation of the pushing or containment teeth for the smallest formats.

Basically, the number of compartments defined along the lower linear stretch has each tooth belonging to a carriage which is able to push and simultaneously contain the bundle as a function of the position in which the group of products is located.

Again as illustrated (in particular in FIGS. 6 to 11), each at least one tooth 10, 11, 12 present on each carriage 9 comprises at least a head 18 permanently connected to the carriage 9 and at least an operating portion 19 in contact with the groups 2 of products which can be separated from and reconnected (in a snap-in fashion) to the head 18.

Preferably, each tooth 10, 11, 12 quick comprises means 20 for rapid connection/detachment positioned between the head 18 and the operating contact portion 19 to allow a stable coupling or a separation of the operating portion 19 to/from the head 18.

The rapid connection/detachment means 20 can be, for example, of the type with a bayonet coupling, with pins movable axially and equipped with a spring for maintaining the closed position, etc.

It should be noted that each head 18 has a central seat 18*a* for housing an end of the operating portion 19 configured to match the central housing seat 18*a*.

In light of this, between the central seat 18*a* and the end of the operating portion 19 there are positioned the rapid connection/detachment means 20.

It should also be noted that the configuration of each tooth is like a "T" where the horizontal stretch is extremely reduced in length and allows relative approach between two successive teeth such that it can contain individual formats of extremely reduced width.

Preferably (FIGS. 6, 8, 9), the head 18 has a seat 18*a* configured, in cross section, in the form of a cross, and wherein the end of the operating portion 19 has a matching shape in the form of a cross in such a way as to allow a coupling of the operating portion 19 according to at least at two different orientations to each other rotated through a right angle.

This feature makes it possible, in a fast and safe fashion, to modify the geometry of the operating portion 19 as a function of the pulling and pushing needs of the groups of products to be handled.

More specifically, this possibility is increased thanks to the fact that the operating portion 19 of each tooth 10, 11, 12 has the shape of a blade defined by two surfaces of reduced width and two surfaces of large width.

In a first alternative embodiment (FIG. 7), each tooth comprises a sheath 21 for external covering which can be coupled to/withdrawn from by sliding in/from the operating portion 19 of the corresponding tooth 10, 11, 12 and which can be locked, by interference, to the same operating portion 19.

In light of this, the sheath 21 has an external size, of operational contact with the group 2 of products, with dimensions greater than the dimensions of the external size of the operating portion 19 (in both the above-mentioned positions).

According to a second alternative embodiment (FIGS. 10 and 11), each head 18 has a stub 18*b* protruding downwards from the head 18 and wherein the operating portion 19 has a relative sector 19*a* which can be placed alongside the stub to form an upper stretch of the operating portion 19.

A joining sheath 21 which can be coupled by sliding and interference to the stub 18*b* and to the operating portion 19 in such a way as to form a complete single operating portion 19.

It should be noted that in this latter alternative embodiment, the sheath 21 may also represent the means 20 for rapid connection/detachment of the operating portion 19 from the head 18.

To complete the structure described above, each carriage 9 comprises:

two end heads 22, 23 connected to a plurality of upper tubes 24 (a pair) for joining the two heads 23, 23 to define a crosspiece having a width equal to the width of the feed plane 1;

at least two half heads 25, 26 connected to the upper tubes 24 and configured for associating with the corresponding chains or belts 8;

at least one head 18 forming a part of the tooth 10, 11, 12 and connected at least to a pair of lower tubes 27, associated with the two end heads 22, 23, in such a way as to allow the head 18 a sliding adjusting along the pair of lower tubes 27 (when necessary);

at least one operating portion 19 in contact with the group 2 of products connected, in a removable fashion, to the head 18.

In light of this, the carriage 9 illustrated has five teeth 10 of which at least four adjustable and a fixed central one for stiffening.

All the teeth present have the possibility of separating the operating portion from the head connected to the carriage.

The machine structured in this way achieves the preset aims thanks to an extremely flexible constructional architecture and which is able to obtain a correct and precise movement on any type of format.

Moreover, thanks to the particular structuring of each tooth, the size changes even with special configurations (non-standard) of the products being processed can be obtained in a rapid, precise manner whilst maintaining a high quality standard of the final product.

The invention claimed is:

1. A machine for packaging soft products, comprising:

a feed plane for feeding groups of products;

a plurality of pulleys located at two ends of the feed plane and connected on at least two shafts driven independently by a first motor and a second motor;

two pairs of chains or belts parallel to and independent from each other, wound on the pulleys, and being movable along a first direction and a feed direction, to define a ring-shaped path having an active linear lower branch facing the feed plane and a non-active linear upper branch;

a plurality of carriages which are connected, alternatively in sequence, to the pairs of chains or belts and distributed along the ring-shaped path; each of the carriages supporting at least one tooth, projecting towards the feed plane during passage on the lower branch, and configured for retaining and feeding along the feed plane the groups of products from a receiving compartment defined by the at least one tooth to an unloading and releasing zone for unloading and releasing the group of products;

a control unit connected to the first and second motors and being configured to control operation of the first and second motors in accordance with variations in a distance between the carriages on the relative pairs of chains or belts as a function of variations in size of the groups of products;

a transfer device including an engagement surface for engaging and moving one group of products at a time, along with a corresponding sheet of wrapping material folded into a "U" shape around the group of products, towards the feed plane and to the receiving compartment, along a second direction transversal to the first direction;

along the lower branch, a number of the carriages equal to a number of groups of products positioned or arrived on the feed plane, in an operational stretch between the receiving compartment and up to the unloading and releasing zone; each of the at least one tooth being configured along the operational stretch to define simultaneously both a pushing tooth with a first surface in engagement with a first group of the products downstream of the tooth and a downstream containment tooth with a second surface opposite the first surface, the second surface configured to engage a second group of the products upstream of the at least one tooth when the at least one tooth is interposed between the first and the second groups of the products consecutively positioned along the feed plane, wherein each of the at least one tooth present on each carriage comprises a head permanently connected to the carriage and an operating portion in contact with the groups of products which is configured to be separable from and reconnectable to the head;

a sheath for each of the at least one tooth, the sheath shaped for externally covering the operating portion to define both the first surface and the second surface and thereby effect both a first area in which the first group of the products is positioned and a second area in which the second group of the products is positioned, the sheath being configured to be removably coupleable to the at least one tooth via a sliding connection with the at least one tooth along a longitudinal axis of the at least one tooth, the sheath being configured to be locked, by an interference fit, to the operating portion; the sheath having an external size, for operational contact with the group of products, with dimensions greater than dimensions of an external size of the operating portion such that the sheath extends further into both the first area and the second area than the operating portion, along the feed plane.

2. The machine according to claim 1, wherein the at least one tooth, includes, along the lower branch, in a minimum operating configuration, a first tooth for pushing and a second tooth for containing positioned on opposite sides of the receiving compartment for receiving a first group of products, and wherein the second tooth, positioned downstream relative to the first tooth with reference to the feed direction, is interposed between the first group of products and a second group of products, located downstream of the first group of products relative to the feed direction, in such a way as to push the second group of products.

3. The machine according to claim 1, wherein the at least one tooth, includes, along the lower branch, in a minimum operating configuration, a first tooth for pushing and a second tooth for containing positioned on opposite sides of the receiving compartment for receiving a first group of products, and wherein the second tooth, positioned downstream relative to the first tooth with reference to the feed direction, is interposed between the first group of products and a second group of products, located downstream of the first group of products relative to the feed direction, in such a way as to push the second group of products, and a third tooth, located downstream of the second tooth with reference to the feed direction, interposed between the second group of products and a third group of products, positioned downstream of the second group of products relative to the feed direction, in such a way as to contain the second group of products and push the third group of products towards the unloading and releasing zone.

4. The machine according to claim 1, comprising a quick coupler positioned between the head and the operating contact portion to allow a stable coupling or a separation of the operating portion to/from the head.

5. The machine according to claim 4, wherein each head includes a central seat for housing an end of the operating portion configured to match the central seat; the quick coupler being positioned between the central seat and the end of the operating portion.

6. The machine according to claim 1, wherein the head includes a seat configured, in cross section, as a cross, and wherein the end of the operating portion has a matching cross shape to allow a coupling of the operating portion according to at least at two different orientations to each other rotated through a right angle.

7. The machine according to claim 1, wherein each head includes a stub protruding downwards from the head and wherein the operating portion has a relative sector which is configured to be placed alongside the stub to form an upper stretch of the operating portion;

wherein the sheath is a joining sheath that is configured to be a sliding and interference fit to the stub and to the operating portion in such a way as to form a complete single operating portion.

8. The machine according to claim 1, wherein each carriage comprises:

two end heads connected to a plurality of upper transversal tubes for joining the two end heads to define a crosspiece having a width equal to a width of the feed plane;

at least two half heads connected to the upper tubes and configured for engaging with the corresponding chains or belts;

a head forming a part of the at least one tooth and connected at least to a pair of lower tubes, connected with the two end heads, in such a way as to allow the head a sliding adjusting along the pair of lower tubes;

the operating portion being in contact with the group of products connected, in a removable manner, to the head.

9. The machine according to claim 1, wherein the operating portion of each of the at least one tooth is shaped as a blade defined by two surfaces of reduced width and two surfaces of large width.

10. A machine for packaging soft products, comprising:

a feed plane for feeding groups of products;

a plurality of pulleys located at two ends of the feed plane and connected on at least two shafts driven independently by a first motor and a second motor;

two pairs of chains or belts parallel to and independent from each other, wound on the pulleys, and being movable along a first direction and a feed direction, to define a ring-shaped path having an active linear lower branch facing the feed plane and a non-active linear upper branch;

a plurality of carriages which are connected, alternatively in sequence, to the pairs of chains or belts and distributed along the ring-shaped path; each of the carriages supporting at least one tooth, projecting towards the feed plane during passage on the lower branch, and configured for retaining and feeding along the feed plane the groups of products from a receiving compartment defined by the at least one tooth to an unloading and releasing zone for unloading and releasing the group of products;

a control unit connected to the first and second motors and being configured to control operation of the first and second motors in accordance with variations in a distance between the carriages on the relative pairs of chains or belts as a function of variations in size of the groups of products;

a transfer device including an engagement surface for engaging and moving one group of products at a time, along with a corresponding sheet of wrapping material folded into a "U" shape around the group of products, towards the feed plane and to the receiving compartment, along a second direction transversal to the first direction;

along the lower branch, a number of the carriages equal to a number of groups of products positioned or arrived on the feed plane, in an operational stretch between the receiving compartment and up to the unloading and releasing zone; each of the at least one tooth being configured along the operational stretch to define simultaneously both a pushing tooth and a containment tooth when the at least one tooth is interposed between two groups of consecutive products along the feed plane, wherein each of the at least one tooth present on each carriage comprises a head permanently connected to the carriage and an operating portion in contact with the groups of products which is configured to be separable from and reconnectable to the head;

wherein each head includes a stub protruding downwards from the head and wherein the operating portion has a relative sector which is configured to be placed alongside the stub to form an upper stretch of the operating portion;

the machine further comprising a joining sheath that is configured to be a sliding and interference fit to the stub and to the operating portion in such a way as to form a complete single operating portion.

* * * * *